United States Patent [19]

Yamanaka et al.

[11] Patent Number: 4,952,265

[45] Date of Patent: Aug. 28, 1990

[54] MAT CONSISTING OF FILAMENT LOOP AGGREGATIONS AND METHOD AND APPARATUS FOR PRODUCING THE SAME

[75] Inventors: Minoru Yamanaka, Tokyo; Tetsuo Amawa, Kasukabe, both of Japan

[73] Assignee: Kabushiki Kaisha Risuron, Tokyo, Japan

[21] Appl. No.: 180,534

[22] Filed: Apr. 12, 1988

[30] Foreign Application Priority Data

Feb. 9, 1988 [JP] Japan ..... 63-2683

[51] Int. Cl.[5] ..... B32B 33/00

[52] U.S. Cl. ..... 156/167; 156/169; 156/181; 156/244.26; 264/168; 264/177.13; 264/178 F; 264/180; 264/211.14; 264/562; 428/92; 428/95; 428/96; 428/222; 428/286; 428/287; 428/288; 428/296

[58] Field of Search ..... 428/85, 92, 95, 96, 428/222, 286, 287, 288, 296; 264/178 F, 168, 177.13, 180, 211.14, 562; 156/167, 169, 181, 244.26

[56] References Cited

U.S. PATENT DOCUMENTS

| | | | |
|---|---|---|---|
| Re. 27,614 | 4/1973 | Brunner et al. | 428/95 |
| 3,481,821 | 12/1969 | Brunner et al. | 428/95 |
| 3,837,988 | 9/1974 | Hennen et al. | 428/95 |

*Primary Examiner*—George F. Lesmes
*Assistant Examiner*—J. Davis
*Attorney, Agent, or Firm*—Ladas & Parry

[57] ABSTRACT

In this mat consisting of filament loop aggregations, irregular form loops are formed in the upright direction by respectively winding to be coil-like many filaments coarse in the arranging intervals and made of a thermoplastic synthetic resin and are fused in the intersecting parts and the other loops are formed in the laterally fallen direction and are fused in the overlapping parts.

16 Claims, 3 Drawing Sheets

MAT CONSISTING OF FILAMENT LOOP AGGREGATIONS AND METHOD AND APPARATUS FOR PRODUCING THE SAME

BACKGROUND OF THE INVENTION

This invention relates to a coarse net-like develop resilient mat made by complicatedly entangling synthetic resin monofilaments and more particularly to a mat consisting of filament loop aggregations and adapted to a porch mat of fixed dimensions or a floor mat formed and laid in a long sheet and a method and apparatus for producing the same.

Instead of a conventional carpet mat or synthetic resin mat, there is recently provided a three-dimensional net-like mat consisting of synthetic resin monofilaments high in the water permeability and quick dryability. Due to such characteristics as the resiliency and weather-proofness, such three-dimensional net-like mat is used in many indoor and outdoor fields, is applied particularly to such water using place as, for example, an inlet and outlet of a bath room or a pool side and is appreciated because it is simple to wash and dry.

Also, as this kind of three-dimensional mat is open, the sand and gravels brought when it is trod will drop down and will not remain on the surface. As water or the like also will drop down, the surface can be always kept dry. It is thus convenient.

In addition, when such elastic sheet as a synthetic resin sheet, foaming sheet or rubber sheet is pasted to the lower surface of such mat, the cushioning property as of a mat will be able to be increased, the sand and water dropping from the surface will be able to be received by this sheet pasted to the lower surface and the floor will be able to be prevented from being made dirty directly by the dropping sand and the like.

DESCRIPTION OF THE PRIOR ART

As disclosed in the gazette of a Japanese patent publication No. 14347/1972, such three-dimensional net-like mat is formed as a non-woven fabric wherein many monofilaments made of a thermoplastic synthetic resin are laminated while being rubbed and bent, are fused at their contact points and are cooled to be solidified.

The formation of upright loops disclosed in the gazettes of a Japanese patent publication No. 31222/1980 and a Japanese patent laid open No. 85061/1987 is known as a web forming means of the above mentioned filaments in such non-woven fabric.

Now, in the non-woven fabric formation by the above described conventional means, in such rubbed and bent web formation, the resiliency of the individual rubbed and bent filament part itself is low, the rubbed and bent filaments by this producing means overlap on each other to fall down and, as a result, as the entangled density of the filaments becomes higher, the resiliency of the sheet will be lost.

Thus, when the mat is used, the treading touch will be obstructed and, when the mat is stored or carried, it will be difficult to wind in the sheet-like mat, much to the inconvenience.

On the other hand, when the web formation is made loop-like, the resiliency of the filament itself in each loop-like part will be developed but, in the web made of arcuate loops arranged in a substantially fixed form, the respective loops are only points between the adjacent loops, are high in the independency and are therefore low in the resiliency against treading and, as a result, no favaroble treading touch will be obtained.

SUMMARY OF THE INVENTION

Therefore, the present invention has it as an object to provide a mat wherein a filament web is formed of positively closed loops to develop a filament resiliency in each loop part and the degree of the contact fusing between the respective loops is made high to be able to develop a strong sheet resiliency and a method and apparatus for producing the same.

DESCRIPTION OF THE DRAWINGS

The many advantages and features of the present invention can be best understood and appreciated by reference to the accompanying drawings wherein.

DETAILED DESCRIPTION OF THE INVENTION

Figure 1:
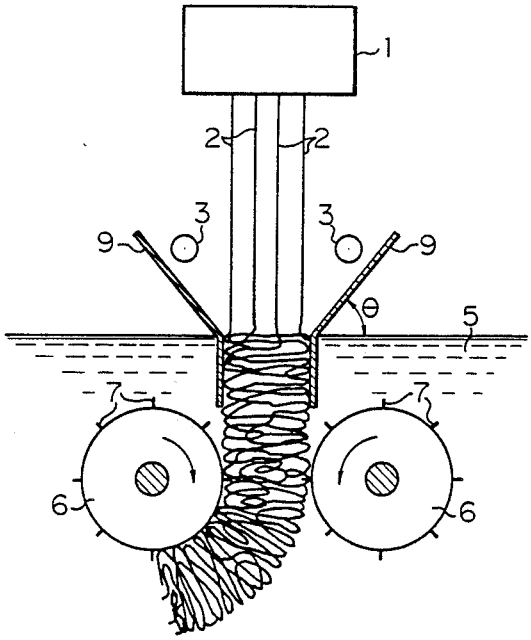
FIG. 1 is a side view of a essential part showing an embodiment of the apparatus of the present invention.

In order to attain such object, according to the present invention, a mat consists of upright disarranged loop-like synthetic resin filament three-dimensional aggregations and has many spaces within it to develop a cushioning property. A mat consisting of loops of various sizes depending on the object of the use can be provided.

In order to firm such mat, several hot filaments of a thermoplastic synthetic resin are pressed and extruded through T-die orifices and are made to fall toward a water surface.

A pair of inclined panels are set as opposed to each other on the water surface and a bundle of the above mentioned filaments is lowered so as to drop between these panels.

The falling hot filaments are heated by such heat sources as ceramic far infrared ray heaters so as not to be cooled by the atmosphere and the inclined parts above water of the above mentioned panels act to prevent the temperature drop of the filaments by the radiation heat reflection.

Such hot filaments are easy to make coiled loops on the water surface. Unless the filaments are hot, the loops will become large. Further, in the filaments of a reduced temperature, no coiled loop will be formed but only a channeled rubbed and bent form will be able to be made.

The height from the die mouth end to the water surface is 5 to 100 cm. and the heat reduction of the filaments is prevented by making the die mouth end approach the water surface as much as possible.

The orifice diameter of the T-die is 0.3 to 1.5 mm. as an element determining the filament diameter, retains the resiliency and durability of the formed filaments and prevents the permanent set.

A mat sheet consisting of filament aggregations of respective widths can be made by arranging the numbers of orifices corresponding to the widths of 90, 120 and 150 cm. of intended mat sheets width an orifice arrangement of a T-die of 3 to 6 longitudinal rows at the intervals of 3 to 5 mm. and a pitch of 3 to 5 mm. in the lateral row.

That is to say, a hot filament bundle extruded out of the T-die of such orifice arrangement is made to fall upright toward cooling water and is received by submerged rolls of a rotary peripheral speed well slower than the falling speed to limit the falling speed in water and to give the filaments a resistance toward the water surface from the above mentioned rolls. Loops having a peripheral length of a filament length corresponding to the difference between the extruding speed of the respective filaments and the falling speed in water will be sequentially continuously formed to be coil-like on the water surface by this resistance.

At this time, in order to make it easy to form loops and to make bent irregular loops, it is effective to keep boiling the cooling water surface between the inclined panels.

This boiling state vibrates the respective filaments wound on the water surface. As a result, entangled disarranged coiled loops are induced on the water surface.

In order to make the boiling state on the water surface between the inclined guide panels, it is important to keep the filaments coming out of the T-die at a high temperature until the liquid level. Generally, when the filaments are in contact with the atmosphere, the filament temperature will quickly reduce. The water surface heated by the falling in water of the filaments bundle kept at a filament extruding molding temperature of 200° to 150° C. by the above mentioned heating treatment to prevent air cooling in the filament coming out of the T-die will be in the boiling state. Therefore, when the cooling water is kept at a high temperature of 60° to 80° C., this boiling will be made positive.

When the filaments are molded to be coiled loops while kept at a high temperature, the fusing between the loops will be accelerated. Further, when the cooling water is at a high temperature, in case the molded loops are pulled out into the atmosphere by the guide rolls and are sent to the secondary process, they will be able to the easily dried with cool or hot air.

A filament loop aggregation in which the coil density is made coarse by increasing the rotation (pulling speed in water) of the rolls in water and is made high by reducing the pulling speed is formed.

By the way, in order to strengthen the filament fusing between the coil and loop and strengthen the durability of the coil itself, it is effective to coat the aggregations with a bonding agent. Thereby, the entire filament loop aggregations can be strengthened and it effective to prevent the permanent set of the upright coil part.

A vinyl plastisol is generally used for the bonding agent in this case. The strength and durability of the mat can be increased by adopting a vinyl plastisol adapted to the materials of the mat and sheet.

It is effective to use a plastisol of the same material mixture as of the filaments for the bonding agent. The bonding agent reduced in the viscosity by adding 20 to 30% plasticizer to the filament material is sprayed or painted or has the above mentioned aggregation dipped in its liquid bath, has then the excess plastisol removed with rollers, is then heated at 170° to 150° C. with a dryer to be melted and is bonded to the filament surfaces of the aggregation to accelerate the fusing bond between the filaments.

By the way, a vinyl plastisol is made by adding a plasticizer and various stabilizers to a powdery vinyl and can be used for the above mentioned object.

On the other hand, even if the thickness width of the hanging filament bundle is not regulated, a three-dimensional formation of a coiled loop will be able to be made. However, the size of the loop formed on the liquid surface is not fixed. Therefore, a means of regulating the thickness width of the filament bundle functions effectively to make uniform coiled three-dimensional aggregations of an intended thickness.

The entire inclined panel is of a stainless steel plate or the part exposed above the cooling water surface may be of a stainless steel plate and the part in the cooling water may be of a stainless steel screen plate. It is effective that the panel angle on the water surface is held to be 45 to 80 degrees in order to reflect the radiation heat from the heat source and to slide into water the filaments having fallen onto the panel surface.

It is effective to keep the temperature of the inclined panel at 100° to 130° C.

By adjusting the opposed clearances of a pair of opposed inclined panels and rolls in water, various modified aggregations of a coiled loop three-dimensional structure can be continuously molded.

Rotary rollers exposed in a part of the peripheral surface on the water surface can be applied instead of such inclined panels. However, in this case, the radiation that reflecting action will be so little as to require a heat source to cope with it.

In molding synthetic resins, the general temperature as of the cooling bath is about 50° C. for PE (polyethylene) and PP (polypropylene), about 10° to 40° C. for PVC (polyvinyl chloride) and about 85° C. for PS (polystyrene).

The surface tension of water on PVC (polyvinyl chloride) is so high as to be about 60 to 70 dym./cm. that fine filaments of an outside diameter less than 1 mm, will be overlapped in turn above the water surface, the coiled loops formed here will be laminated in several steps and will be cooled in water and therefore the object aggregations coarse in the loop clearances will not be obtained. Therefore, in order to sequentially sink the coiled loops on the liquid surface, it is effective to add a surface active agent reducing the surface tension of the cooling bath.

EMBODIMENTS

FIG. 1 is a side view showing component parts in an optimum apparatus for embodying the present invention. Four filaments 2 are to fail vertically toward cooling water 5 while being molded in the thickness direction (longitudinal direction) from a T-die 1 extruding a thermoplastic synthetic resin material under pressure.

In the lateral direction (front to back direction on the paper surface) of the T-die in this case, many filaments 2 are to be molded as arranged at predetermined intervals (pitch of 3 to 5 mm.) in the length zone corresponding to the lateral width of an intended molding.

In the falling zone of these filaments 2, bar-like ceramic far infrared ray heaters 3 are arranged on both sides of the filament bundle so as to be heating heat sources. Laterally long inclined panels 4 are arranged respectively below these heater 3.

The above mentioned inclined panel 4 consists of an upper piece 4*a* of a horizontal angle $\theta$ set in the range of 45 to 80 degrees and a lower piece 4*b* submerged below the water surface of the cooling water 5. The lower pieces 4*b* are arranged so as to hold the above mentioned filament bundle from both sides and the panels 4 are formed so as to be adjustably movable toward the center of the filament bundle from both sides.

As a result, the filament bundle will be limited in the thickness width by the above mentioned panels 4 in the zone reaching the water surface of the cooling water 5, further the outside filaments 2 of the bundle will fall onto the upper parts 4*a* of the panels 4, will slide on the upper parts 4*a* and will be submerged into the cooling water 5.

Further, submerged rollers 6 formed movably in the direction of the above mentioned thickness width as operatively connected with the above mentioned panels 4 are arranged in the cooling water 5, have many engaging pins 7 for stopping sliding erected on the peripheral surface of the rollers 6, periodically rotate in the winding direction indicated by the arrow in the same drawing and are controlled in the rotating speed to be lower than the falling speed of the above mentioned filaments 2.

Therefore, as the respective filaments 2 falling from the T-die 1 at a high speed are reduced in the sinking speed in water by the above mentioned submerged rollers 6, they will be relaxed by the filament length corresponding to the difference between the falling speed and sinking speed. These relaxations will concentrate in the water surface zone due to the buoyancy of the filaments 2 of a small specific gravity. As a result, the filaments 2 will form loops on the water surface.

Figure 2:
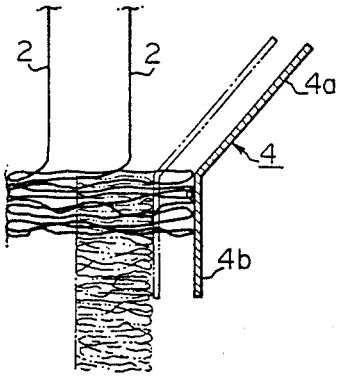
FIG. 2 is an explanatory view showing a filament loop forming state by the apparatus of the present invention.

This state is shown in FIG. 2. That is to say, the filaments 2 extruded out of the T-die will reach the water surface of the cooling water 5 while being kept near the temperature at the time of molding by heating by the above mentioned heaters 3 in the falling zone in air and by the reflected heat from the upper parts 4*a* of the inclined panels 4. The filaments 2 having sunk in the cooling water 5 will quickly lower in the temperature and will be hardened. However, these hardened filaments 2 will be regulated in the pulling amounts by the submerged rollers 6 stopped in sliding by the engaging pins 7, therefore the hardened parts in water will be subjected to resistances from the submerged rollers 5 and thereby the soft filaments 2 still at a high temperature just before reaching the water surface will be curved and will be gradually pulled into water while describing loops to form coiled loops.

When the temperature within the bath of this cooling water 5 is kept at 60° to 80° C., the cooling water 5 between the above mentioned inclined panels 4 will be locally boiled by heating by the filaments 2 reaching the water surface while at a high temperature. By this boiling, the water surface of that part will be waved and greatly rocked and therefore the filaments 2 describing loops on this water surface will be waved and disarranged in response to the rocking of the water surface.

Therefore, the total surface contact will be obstructed by the concavo-convexes by this disarrangement between the adjacent loops of the disarranged forms overlapped on the water surface and the contact point parts will be comparatively many.

In such contact part, loop will be fused with each other between them and will be cooled to be hardened. Therefore, coiled loops having comparatively many fused parts between the adjacent loops will be continuously formed in turn and a mat sheet (See FIG. 4(*a*)) consisting of a filament loop aggregation A in which coiled loops $a_1$ are cross-linked longitudinally and laterally with loop edges overlapping between adjacent filaments 2 will be formed.

As understandable from the structure of the above mentioned illustrated aggregation A, in the aggregation A in which the respective loops are formed horizontally at the time of the above mentioned working, the above mentioned respective loops will rise in the upright direction when the continuous body is used as horizontally placed.

On the other hand, as shown in the above mentioned FIG. 2, the outside filaments 2 hardened on the upper part 4*a* of the panel 4 by entering toward the center from outside the filament bundle falling on the inclined panel 4 will describe loops on the slope of the part 4*a*, will be heaped up, will therefore slip down into the cooling water 5 along the above mentioned part 4*a* while the adjacent loops are substantially close to the total surface contact and will be hardened. Therefore, as shown in the same drawing, these filament parts will become layers of a high filament density consisting of a loop direction at right angles with the above described coiled loop $a_1$ by the other center part filaments 2 and will be fused with each other on the contact surface of the coiled loop $a_1$.

Figure 4:
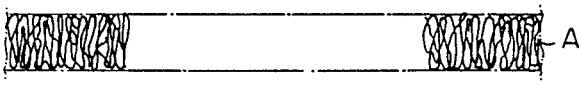
FIGS. 4A–E is a side view showing respective example of the mat of the present invention.
Figure 4:
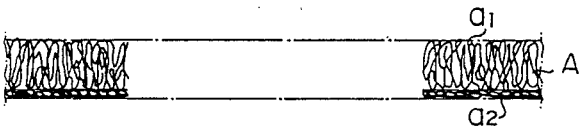
Figure 4:
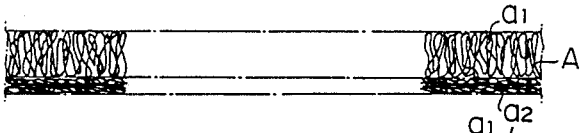
Figure 4:
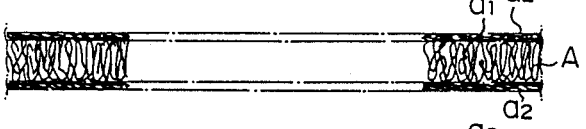
Figure 4:
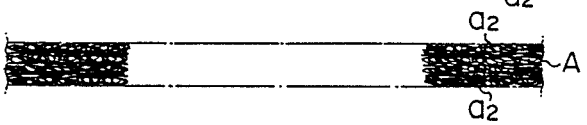

Therefore, as shown in FIG. 4(*b*), the filament loop aggregation A will become an aggregation of the above mentioned layer consisting of a loop $a_2$ laterally fallen on one side of the above mentioned coiled loop $a_1$.

When the movement within the filament bundle of the above mentioned inclined panel 4 is adjusted and the above mentioned laterally fallen loop $a_2$ is formed for several filaments outside the filaments 2, an aggregation A (See FIG. 4(*c*)) consisting of the laterally fallen loops $a_2$ of thick layers will be formed and, when the panels 4 are both moved and the above mentioned laterally fallen loops $a_2$ are made for both outside filaments 2 of the filament bundle, an aggregation A (See FIG. 4(*d*)) in which layers of the laterally fallen loops $a_2$ are formed on both front and back sides holding the coil loop $a_1$ will be formed and an aggregation A (See FIG. 4(*e*)) in which the entire filament bundle is made layers of laterally fallen loops $a_2$ will be able to be formed.

By the way, the formation of such various aggregations A is determined by the corresponding positions of the bundle of the filaments 2 falling as arranged from the T-die 1 and of the inclined panels 4, it is theoretically possible to use a T-die different in the filament extruding spacing (nozzle pitch spacing) for fixed guide panels besides the above described operation of moving the above mentioned panels 4.

Figure 3:
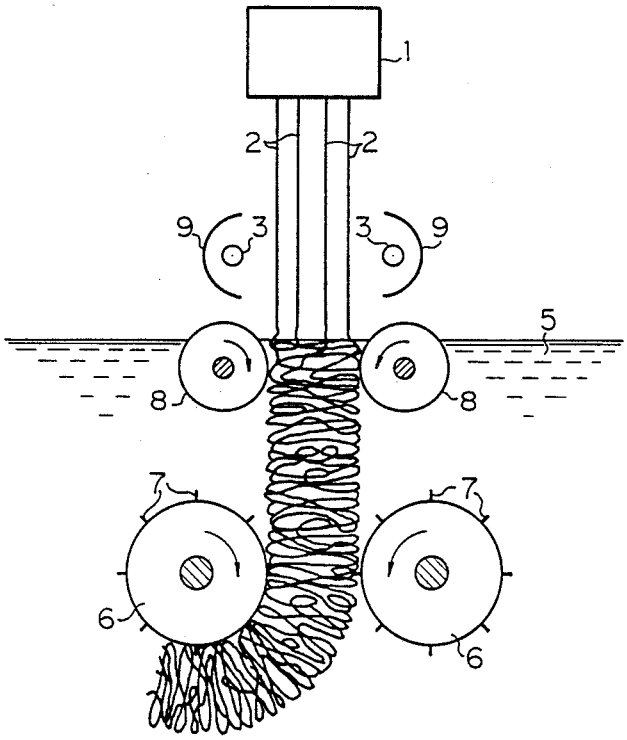
FIG. 3 is a side view of an essential part showing another embodiment of the apparatus of the present invention.

FIG. 3 is a side view of an essential part showing another embodiment of the present invention apparatus. Instead of the inclined panels 4 in the above mentioned embodiment, a pair of water contacting rolls 8 exposed by about 10 to 20% of the diameter above the water surface may be provided rotatably and laterally movably. The other parts similar to the respective parts of the above mentioned embodiment shall bear respectively the same reference numerals. 9 represents a reflecting plate.

According to this embodiment, the thickness width of the filaments 2 falling from the T-die 1 is regulated by these rolls 8. When these rolls 8 move toward the filament bundle, the outside filament 2 will fall onto the peripheral surface of the roll exposed above the water surface to form a layer of the above described laterally fallen loops $a_2$ and the layer part will be pulled into the cooling water 5 by the above mentioned rolls 8 while rotating by the action of pulling it into the loop filaments by the submerged roller 6.

The same as in the above mentioned embodiment, various aggregations A in FIGS. 4(*a*) to 4(*e*) can be formed by regulating the positions of the rolls 8 for the filament bundle.

By the way, in order to pull the cooled loops formed on the cooling water surface into water without disturbing their form, a surface active agent is added into cooling water 4.

Amounts of addition of surface active agents per 100 parts of water:

Anionic system:

Alkylbenzenesulfonate: 1 to 0.2 part.

Dialkylsulfosuccinate: 1 to 0.5 part.

Nonionic system:

Polyoxyethylene nonylphenol ether: 1 to 0.1 part.

It is effective to add 0.05 to 0.2% dialkylsulfosuccinate which is high in the capacity of reducing the surface tension and in the connecting effect with a slight amount.

Now, in this kind of apparatus, in order to keep the cooling bath level constant, cooling water is circulated with a pump while being overflowed. In such case, many bubbles will be generated in an auxiliary tank level detecting electrode and cooling bath and will be disadvantageous in molding. In this respect, at the above mentioned effective component concentration of the dialkylsulfosuccinate, many bubbles tend to be generated. Therefore, it can be said to be optimum to add and use preferably 0.05 to 0.2% dialkylsulfosuccinate.

The thus formed filament loop aggregation A may be coated with a plastisol made of the same material mixture as of the filament to prevent the bonding strength reduction and permanent set of the filament loops.

Figure 5:
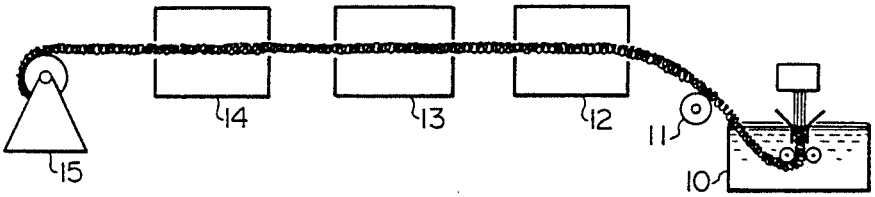
FIG. 5 is a step diagram for producing sheets formed by using the method of the present invention.

The apparatus formation therefor is shown in FIG. 5. An aggregation A pulled up from a bath 10 of the above mentioned cooling water 5 is fed into a primary dryer 12 by a feeding roller and is dried at a low temperature. In this drying, the aggregation A is still about 70° C. by the cooling water 5 at a high temperature. Therefore, the water can be comparatively easily and positively removed by blowing warm wind or the like.

Figure 6:
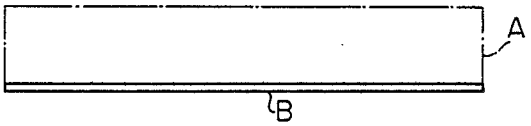
FIG. 6 is a side view showing another embodiment of the mat of the present invention.

The dried aggregation A is fed into a surface coating process part 13 by the above mentioned plastisol, is processed in the part 13 by such means as blowing, painting or dipping, is then fused by high temperature drying in a secondary dryer 14 and is wound up on a winder 15. As shown in FIG. 6, a back sheet B consisting of a resin sheet, foamed sheet, resin net-sheet or rubber sheet etc. may be used as bonded to the back surface of this aggregation A in response to the object of use of the mat or sheet.

FORMATION EXAMPLE 1

| | |
|---|---|
| Polyvinyl chloride (PVC) (P-1300) | 100 parts |
| Plasticizer DOP Dioctyl phthalate | 50 parts |
| Stabilizer Dibutyl tin laurate | 2 parts |
| Stabilizer Cadmium stearare | 0.6 part |
| Stabilizer Barium stearare | 0.4 part |
| Coloring agent | 0.1 part |

A compound material of the above mentioned mixture is molded to be filaments by an extruding molder.

The clearance between the inclined panels on the cooling water surface is set a 15 mm. The filament molding orifice diameter of the T-die is made 0.8 mm. The T-die orifice arrangement is of four longitudinal rows at the intervals of 4 mm. and a lateral orifice pitch of 5 mm.

The clearance between the T-die and cooling water surface is 5 cm. The die temperature is 185° C. The die pressure is 90 kg./cm$^2$. The extruding pressure is 190 kg./cm$^2$. The cooling water temperature is 60° to 80° C. The guide panel temperature is 120° C. Two ceramic far infrared ray between of 2.5 KW each are used. At a molding linear speed of 2 m. per minute, loops at a speed of 40 cm. per minute can be made.

In this formation, by only holding the filament bundle in its thickness width direction with the inclined panels, the front and back surface of the aggregations can be uniformed and the aggregations shown in FIG. 4(*a*) is obtained and is made a product through drying and bonding steps.

As the extruder die pressure is applied and hot filaments are extruded into air, the finished dimension of the filament is 0.2 mm. thicker than the filament orifice of a diameter of 0.8 mm. of the T-die and a filament coil structure of a diameter of 1 mm. is made. Even if the clearance between the inclined panels is set to be 15 mm., the aggregation molded under the width regulation by this clearance will shrink when the filament is hardened and will be therefore 13.5 to 14 mm. thick. The loop diameter is about 7 mm.

Under the above mentioned setting, when one of the inclined panels and water rollers is moved by 2 mm. toward the center part of the filament bundle, the aggregation form shown in the above mentioned FIG. 4(*b*) will be formed. When it is further moved by 2 mm. in addition, the aggregation form shown in FIG. 4(*c*) will be able to be formed.

The aggregation is FIG. 4(*b*) is higher in the adhesion to the floor as a mat or sheet than the aggregation in FIG. 4(*a*), can be increased in the strength by the laterally fallen direction loops in the aggregation, is high in the cushioning and is effective.

In the mat sheet consisting of the aggregations in FIG. 4(*c*), as the lateral direction coil is double, the mat strength can be further increased but the cushioning property is lower than of the aggregation in FIG. 4(*b*).

FORMATION EXAMPLE 2

| | |
|---|---|
| PVC Polyvinyl chloride (P-1300) | 100 parts |
| Plasticizer DIDP diisodecyl phthalate | 5.5 parts |
| LK-40 Organic cadmium chelate | 0.5 part |
| Cadmium stearate | 0.7 part |
| Barium stearate | 0.3 part |
| Coloring agent | 0.1 part |

A compound material of the above mentioned mixture is molded with an extruder.

The clearance between the inclined panels on the cooling water surface is 15 mm. the clearance between the submerged rollers is also set at 15 mm. The filament molding orifice diameter of the T-die is set at 0.8 mm. The T-die hole arrangement is of four longitudinal rows at the intervals of 5 mm. and a lateral orifice pitch of 5 mm. The distance from the T-die to the cooling water surface is 5.5 cm.

The T-die temperature is 190° C. The die pressure is 80 kg./cm$^2$. The extruding pressure is 190 kg./cm$^2$. The cooling bath temperature is 60° to 80° C. The guide panel temperature is 120° C. Two ceramic far infrared ray heaters of 2.5 KW each are used. At a molding linear speed of 2 m. per minute, loops at a speed of 50 cm. per minute can be made.

Thereby, an aggregation in the form shown in FIG. 4(*b*) of a filament diameter of 1.1 mm., loop diameter of 6 to 10 mm. and aggregation thickness of 14 mm. can be molded.

FORMATION EXAMPLE 3

The compound material is the same as in the Formation Example 2.

The respective clearance of the inclined panels and submerged rolls are made 10 mm.

The T-die filament orifice diameter is 0.4 mm. The T-die orifice arrangement is of four longitudinal rows at the intervals of 3 mm. and lateral orifice pitch of 3.5 mm. The distance from the T-die to the cooling water surface is 5 cm. The T-die temperature is 185° C. The die pressure is 150 kg./cm$^2$. The extruding pressure is 180 kg./cm$^2$. The cooling bath temperature is 60° C. to 80° C. The inclined panel temperature is 120° C. Two ceramic far infrared ray heaters of 2.5 KW each are used. The linear speed of the filament is set at .35 m. per minute. The feeding speed is set at 70 cm. per minute.

Thereby, an aggregation in the form shown in FIG. 4(*c*) of a filament diameter of 0.5 mm., loop diameter of 6 to 10 mm. and aggregation thickness of 9 mm. is molded.

FORMATION EXAMPLE 4

The compound material is the same as in the Formation Example 1.

The T-die orifice arrangement is of four longitudinal rows at the intervals of 5 mm. and a lateral orifice pitch of 5 mm. The inclined panel clearance is set at 14 to 13.5 mm. The distance from the T-die to the cooling water surface is 5 cm.

The T-die orifice diameter is 0.8 mm. The die temperature is 185° C. The die pressure is 90 kg./cm$^2$. The extruding pressure is 190 kg./cm$^2$.

Thereby, there is formed an aggregation in the form shown in FIG. 4(*d*) in a sandwich state wherein the front and back parts of the aggregation have flat smooth surfaces, upper and lower loops are formed in the lateral direction and the interior is of a three-dimensional coil structure. According to this aggregation, there are advantages that, as both front and back surfaces are flat and smooth and are different from open coil-like surfaces, shoes or the like will not catch on the surfaces in walking and the resiliency is higher than of general sheets.

It can be applied to a slope for summer skiing as another use than for mats.

FORMATION EXAMPLE 5

The compound material and other settings are the same as in the Formation Example 4. The clearance between the inclined panels is set at 1 cm.

Thereby, a filament loop aggregation high in the density of such structure as of pressed coiled loops is made and is low in the resiliency but is highest in the strength. It is sheet-like on the surface but is formed of laterally falling direction coiled loops in the interior and is therefore adapted to the object of a mat passing soil, sand, rain and water. Therefore, it is effective for a gate in a place where many people walk. As different from the case that the surface is of open coils, it will not catch on shoes when walking or will not cut loops.

It can be expected to be extensively utilizable for slopes for summer skiing.

EFFECTS OF THE INVENTION

Thus, according to the mat of the present invention, as an aggregation is formed of irregular form loops by winding filaments to be coil-like, the individual closed loops well develop the filament resiliency, are of such irregular form as a wavy form and are therefore high in the degree of the contact fusing between the adjacent continuous coiled loops and between the filament forming loops arranged longitudinally and laterally and thus a mat high in the bonded degree as a whole can be obtained. In the mat in which such loops are formed in the upright direction, in addition to the resiliency of the above mentioned loops themselves, a stiff mat resiliency can be obtained by the strength of the bonded degree between these loops and a porch mat or floor sheet very high in the treading touch can be obtained.

The mat is which these loops are formed in the laterally fallen direction is low in the resiliency but is high in the tensile strength and durability, has clearance spaces sufficient to drop the sand, dirt and water deposited on the mat down to the lower surface and is therefore effective to be used for a long floor sheet in an establishment or the like where many people walk in and out or for a slope for skiing.

Further, by combining and bonding upright direction loops and laterally fallen loops with each other, there can be obtained a simple convenient practical mat or sheet having characteristics of the individual mat made of both loops described above.

As elastic back sheet as pasted to such mat or sheet reinforces the mat elasticity and is so high in the affinity with the set floor surface as to be unlikely to slide or peel off. Particularly, the sand and water dropped on the lower surface can be received by the back sheet and the floor surface or the like is not directly dirtied.

When the diameter of the filament in this case is set to be in the range mentioned in claim 5, the practical strength of the filament loop can be obtained and, on the other hand, the mat can be made high in the sheet weight convenient to the setting work and in the treading touch.

When the major diameter of the loop of an irregular form is adjusted to be in the rage mentioned in claim 6, it will be effective in keeping the mat elasticity but, on the other hand, if the major diameter of the loop is too large, a shoe tip or like will catch on and cut the loop and such danger as falling down will be likely to be caused. Thus, it is not preferable.

In the method of forming a mat or sheet consisting of such filament loop aggregations, the filaments are lowered onto the water surface while near the molding temperature and, when this water surface is waved by boiling, the loops formed on the water surface will be able to be in such irregular forms as very forms and to be contact-fused in the loop intersecting parts and between the loops.

In addition, when the filament bundle falling toward the cooling water surface is regulated in the direction of contracting from outside the width of the thickness direction of the bundle, the sizes of the respective loops formed of these filaments will be able to be uniformed and, when the contracted width is controlled, the formation of combining the above described upright direction loops and laterally fallen loops will be able to be freely made.

When inclined panels are applied as these contracting devices, they will be also plates for reflecting the radiation heat from heat sources for holding the temperature at the time of molding the above mentioned filaments, will be very effective to keep the temperature of said filaments and will be simple and effective devices which will be also laterally fallen loop forming members.

When guide rollers partly exposed on the water surface are used as these contracting devices, a heat reflecting effect will not be able to be expected but, by the filament pulling action by the submerged rollers driving the guide rollers or under free rotation, the filament loops formed on the exposed peripheral surface of the guide rollers will be able to be sunk into cooling water with little resistance and therefore the loop forms will not be uselessly disturbed. As a result, they are very effective to form uniform loop forms over all the range of the aggregation.

The pawled formations on the peripheral surfaces of the above mentioned submerged rollers are desirable to stabilize the speed of the filaments controlled by then in the sinking speed.

If the distance from the T-die to the cooling water surface is long, the filament temperature will be reduced by air between them. Therefore, it is desirable to set the distance to be as short as possible. However, if they are too adjacent, the loop formation on the water surface will be disturbed. Therefore, this distance of 5 to 10 cm. is effective.

By keeping the temperature of the cooling water at a comparatively high temperature of 60° to 80° C., a local boiling state in which the wear surface on which the filaments fall is properly waved by heating by the filaments submerging into water can be automatically obtained. In order to smoothly sink the filaments to prevent the loop forms from being disturbed, it is effective to added a surface active agent. By treating the filament loop aggregation on the surface with an adhesive, the practical strength of the mat or sheet can be elevated.

What is claimed is:

1. A method of producing a mat comprised of a plurality of filaments comprising the steps of:

extruding a plurality of resin filaments from an extruder such that said filaments fall toward a cooling liquid held at a temperature of 60 to 80 degrees centigrade;

heating the filaments as they fall toward the cooling liquid to keep said filaments at least close to their extrusion temperature;

maintaining the surface of the cooling liquid in a boiling state thereby causing said filaments to loop and bond at a plurality of points upon reaching the surface of said cooling liquid, said boiling action causing said filaments to bond at more points than would normally occur absent such boiling;

regulating the width of the filament loop aggregation created when said filaments loop and bond in the cooling liquid surface by means of a first pair of regulating means, said first pair of regulating means being situated opposite each other near the surface of said cooling liquid; and regulating the width of said filament loop aggregation as it sinks under the surface of said cooling liquid by means of a second pair of regulating rollers having a plurality of engaging pins.

2. The method of claim 1 wherein by adjustment of said first pair of regulating means the density of said filament loop aggregation may be adjusted such that if the distance between said first pair of regulating means causes at least a number of said filaments to impinge on at least one of said first pair of means, density of said filament loop aggregation will be greater in the area of said impingement to yield a flatter denser portion of said loop aggregation.

3. The method of claim 2 wherein said second pair of regulating means is located below said first pair of regulating means and below the surface of said cooling liquid.

4. The method of claim 2 where said first pair of regulating means comprises lower panels extending generally vertically below said cooling liquid surface.

5. The method of claim 2 further comprising heating means for heating said filaments and wherein said first pair of regulating means comprises upper panels which form an angle with said cooling surface of between 45 and 80 degrees, said upper panels acting to reflect the heat from said heating means onto said filaments and to impinge upon some of said filaments prior to said some filaments reach said surface of said cooling liquid.

6. The method of claim 4 further comprising heating means for heating said filaments and wherein said first pair of regulating means comprises upper panels connected to said lower panels, said upper panels forming an angle with said cooling surface of between 45 and 80 degrees, said upper panels acting to reflect the heat from said heating means onto said filaments and to impinge upon some of said filaments prior to said some filaments reach said surface of said cooling liquid.

7. The method of claim 2 wherein said first pair of regulating means are guide rollers, a majority of said guide rollers extending below said cooling liquid surface.

8. The method of claim 7 wherein approximately 10 to 20% of the diameter of said guide rollers extends above said cooling liquid surface to impinge on said filaments and carry said filaments into said cooling liquid.

9. The method of claim 2 wherein said second pair of regulating means is located below said first pair of regulating means and below the surface of said cooling liquid, second pair of regulating means being a pair of pawled rollers whose distance from each other is adjustable with the adjustment of said first pair of regulating means, said second pair of regulating means causing said filaments to sink in said cooling liquid at speed less than that at which said filaments descended from said extruder which is a T-die to said cooling liquid.

10. The method of claim 2 further comprising heating means for heating said filaments in said heating step and reflecting means associated with said heating means for reflecting the heat from said heating means onto said filaments.

11. The method of claim 1 wherein all of said filaments impinge on said regulating means to yield a uniformly dense mat.

12. A method of producing a mat consisting of filament loop aggregations according to claim 9 wherein the distance from the lower surface of the T-die to the water surface is in the range of 5 to 10 cm.

13. A method of producing a mat consisting of filament loop aggregations according in claim 2 wherein the cooling water held at a temperature of 60° to 80° C. is locally boiled by heating by the sinking loops just below the fall of said filaments.

14. A method of producing a mat consisting of filament loop aggregations according to claim 2 wherein about 0.005 to 0.2% surface agent dialkylsulfosuccinate is added into cooling water.

15. A method of producing a mat comprised of a plurality of filaments comprising the steps of:

extruding a plurality of resin filaments such that they fall toward a cooling liquid held at a temperature of 60 to 80 degrees centigrade;

heating the filaments as they fall toward the cooling liquid to keep said filaments at least close to their extrusion temperature;

maintaining the surface of the cooling liquid in a boiling state thereby causing said filaments to loop and bond at a plurality of points upon reaching the surface of said cooling liquid, said boiling action causing said filaments to bond at more points then would normally occur absent such boiling;

regulating width of the filament loop aggregation created when said filaments loop and bond on the cooling liquid surface by means of a first pair of regulating means, said first pair of regulating means being situated opposite each other near the surface of said cooling liquid and causing the tip of each filament loop to bend and bond against the tip of a neighboring filament loop so that the outside edges of the filament loop aggregations are comprised of slightly bent and bonded filament loop ends.

16. A method of producing a mat comprised of a plurality of filaments comprising the steps of:

extruding of plurality of resin filaments such that said filaments fall toward a cooling liquid held at a temperature of 60 to 80 degrees centigrade;

heating the filaments as they fall toward the cooling liquid to keep said filaments at least close to their extrusion temperature;

maintaining the surface of the cooling liquid in a boiling state in part through the receipt of the heated filaments into the cooling liquid, said boiling state causing said filaments to loop and bond at a plurality of points upon reaching the surface of said cooling liquid, said boiling action causing said filaments to form irregular filament loops thereby causing them to bond at more points than would normally occur absent such boiling;

regulating the width of the filament loop aggregation created when said filaments loop and bond in the cooling liquid surface by means of a first pair of regulating means, said first pair of regulating means being situated opposite each other near the surface of said cooling liquid; and regulating the width of said filament loop aggregation as it sinks under the surface of said cooling liquid by means of a second pair of regulating rollers having a plurality of engaging pins.

* * * * *